US011885196B1

(12) United States Patent
Nettles et al.

(10) Patent No.: US 11,885,196 B1
(45) Date of Patent: Jan. 30, 2024

(54) RETRIEVABLE PACKER WITH SLOTTED SLEEVE RELEASE

(71) Applicants: CNPC USA Corporation, Houston, TX (US); BEIJING HUAMEI, INC., Beijing (CN); CHINA NATIONAL PETROLEUM CORPORATION, Beijing (CN)

(72) Inventors: Damon Nettles, Houston, TX (US); Perry Batson, Houston, TX (US); Kwami Roberts, Missouri City, TX (US); Peng Cheng, Houston, TX (US); Jianpeng Yue, Sugar Land, TX (US)

(73) Assignees: CNPC USA Corporation, Houston, TX (US); Beijing Huamei, Inc., Beijing (CN); China National Petroleum Corporation, Beijing (CN)

( * ) Notice: Subject to any disclaimer, the term of this patent is extended or adjusted under 35 U.S.C. 154(b) by 0 days.

(21) Appl. No.: 18/049,188

(22) Filed: Oct. 24, 2022

(51) Int. Cl.
*E21B 33/129* (2006.01)
*E21B 23/06* (2006.01)
*E21B 33/12* (2006.01)

(52) U.S. Cl.
CPC ..... *E21B 33/1291* (2013.01); *E21B 23/06* (2013.01); *E21B 33/1208* (2013.01)

(58) Field of Classification Search
CPC .. E21B 33/1208; E21B 33/1292; E21B 23/06; E21B 29/00
See application file for complete search history.

(56) References Cited

U.S. PATENT DOCUMENTS 5,197,547 A * 3/1993 Morgan ..... E21B 23/06 166/387
5,273,109 A * 12/1993 Arizmendi ..... E21B 23/06 166/134
5,311,938 A 5/1994 Hendrickson et al.
5,333,685 A * 8/1994 Gilbert ..... E21B 23/065 166/134
5,449,040 A * 9/1995 Milner ..... E21B 33/1293 166/123
6,364,017 B1 * 4/2002 Stout ..... E21B 23/06 166/278
6,422,317 B1 7/2002 Williamson, Jr.
(Continued)

FOREIGN PATENT DOCUMENTS

WO 2019100138 A1 5/2019

*Primary Examiner* — Yong-Suk (Philip) Ro
(74) *Attorney, Agent, or Firm* — Craft Chu PLLC; Andrew W. Chu

(57) ABSTRACT

The retrievable packer system includes a packer mandrel, a lock ring, an upper cone, a lower cone, a slip device, a retrieval mandrel, and a slotted retrieval sleeve. The lock ring is attached to the packer mandrel, followed by the upper cone, the slip device, the lower cone, and the retrieval mandrel. The upper connection sleeve and the lower connection sleeve cover the packer mandrel so as to form a chamber in fluid connection with slip flow channels of the slip device. The packer system is run into the borehole with the slotted retrieval sleeve in the first position relative to the lower cone and the slip device in the run-in position. The packer system is set and can be locked at a location in the borehole. The slotted retrieval sleeve can push the upper cone to return the slip device to the run-in position for retrieval of the packer system.

20 Claims, 6 Drawing Sheets

(56) References Cited

U.S. PATENT DOCUMENTS

| | | | | |
|---|---|---|---|---|
| 6,691,788 | B1 | 2/2004 | Dearing | |
| 7,377,327 | B2 | 5/2008 | Jackson | |
| 8,291,976 | B2 | 10/2012 | Schultz et al. | |
| 10,024,150 | B2 | 7/2018 | Andreychuk et al. | |
| 10,077,633 | B2 | 9/2018 | Purkis et al. | |
| 11,002,103 | B2 | 5/2021 | Vasques | |
| 11,512,555 | B2 * | 11/2022 | Batson | E21B 33/1208 |
| 2004/0026092 | A1 * | 2/2004 | Divis | E21B 33/128 166/134 |
| 2005/0139362 | A1 | 6/2005 | Coon et al. | |

* cited by examiner

RETRIEVABLE PACKER WITH SLOTTED SLEEVE RELEASE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to isolating zones in a wellbore. More particularly, the present invention relates a retrievable packer system that attaches to and releases from a location in the wellbore. Even more particularly, the present invention relates to a packer system with a slotted sleeve to release the packer system set at the location in the wellbore for downhole operations from the location in the wellbore, after the downhole operations are completed.

2. Description of Related Art Including Information Disclosed Under 37 CFR 1.97 and 37 CFR 1.98

Within a wellbore, the hydrocarbons are located at particular depths within a rock formation. These depths can be organized into production zones so that the delivery of production fluids can be targeted to the location of the hydrocarbons. The production fluids facilitate the recovery of the hydrocarbons from the wellbore. Other depth levels do not contain hydrocarbons, which can be called "non-productive zones". There is no need to waste production fluids on non-productive zones without hydrocarbons. Thus, the productive zones are isolated from the non-productive zones for the recovery of hydrocarbons from the wellbore.

There are known downhole tools to separate a production zone from a non-productive zone so that the production fluids can be delivered to the production zone and not the non-productive zone. Examples of downhole tools to isolate zones include a plug, a packer or other tool with an isolation valve.

In the conventional process, the packer is run downhole into the wellbore. When at the correct location within the wellbore, the packer is expanded against the walls to be fixed at the location within the wellbore. Slip devices from a retracted position are actuated to an expanded position by cone assemblies. In the expanded position, the slip devices grip the walls of the wellbore to hold the location of the packer. The downhole operations can be performed with the packer fixed at the location. When the downhole operations are completed, the packer must be removed, and retrievable packers are known. There are several methods to release a slip device from the location. Cutting off the slip device or at least a portion of the slip device, forcibly pulling the slip device free, and mechanically separating the slip device from the location with wedges and other levers. There are several methods to release the cone assemblies from the slip devices as well. The cone assemblies exerted the force to expand the slip device for gripping, so separating the cone assemblies from the slip devices removes the support of the slip devices at the location.

Removing or separating the cone assemblies from the slip devices is a known method for releasing the packer for retrieval. There are known snap rings and collet fingers to release cone assemblies from the slip devices. U.S. Pat. No. 6,691,788, issued on 17 Feb. 2004 to Dearing, discloses a packer with a collet member to expand and retract slip devices. U.S. Pat. No. 5,311,938, issued on 17 May 1994 to Hendrickson et al, discloses a packer with a lock ring to release the slips from the packer. Snap rings can cause issues due to having a typically small bearing area. If more force is required to disengage the cone assemblies and slip devices, the snap ring breaks and fails to release the slip devices from the location.

FIGS. 1 and 2 also show the prior art embodiment of a packer system 1 with a packer mandrel 3 inserted into a cone 4. A retrieval sleeve 5 attached to the packer mandrel 3 slides the packer mandrel 3 along the cone 4 to set and release slips (not shown). In FIGS. 1 and 2, an outer sleeve 2, having slots 6 and a vent 7, cover the packer mandrel 3 and the retrieval sleeve 5 to form a chamber 8. The actuation of the packer mandrel 3 by the retrieval sleeve 5 forces fluid in and out of the chamber 8 and through the vent 7 as shown by the broken line arrow through the packer system 1. Drilling fluid is very heavy and dirty with tailings, debris, rocks, gases, and chemicals. The vent 7 is frequently clogged by various debris, resulting in hydraulic resistance against the movement of the retrieval sleeve 5 to actuate the packer mandrel 3 when releasing the packer system 1. The chamber 8 of fluid without a functional vent can jam the retrieval sleeve so that the packer system 1 cannot be retrieved.

Slotted sleeves are known components in packer systems. Conventionally, slotted sleeve and slotted tubulars have been used as flow channels to guide fluid flow through various parts of the packer system. See U.S. Pat. No. 8,291,976, issued on 23 Oct. 2012 for Schultz et al, and World Intellectual Property Organization (WIPO) publication No. WO2019100138, published on 31 May 2019 for Campbell, which both disclose slots, channels, and complex indentations to control fluid flow between layers of concentric sleeves. U.S. patent Ser. No. 10/024,150, issued on 17 Jul. 2018 for Andreychuk et al, and US Publication No. 2005/0139362, published on 30 Jun. 2005 for Coon et al, disclose slot housings as a fluid bypass around an outer seal of the tool. The functionality of a flow path created by slots in a slotted sleeve is disclosed, but there are various relationships to other components around this slotted sleeve are unique in the patented prior art.

It is an object of the present invention to provide a retrievable packer system to isolate zones in a wellbore for downhole operations.

It is an object of the present invention to provide a retrievable packer system to be set in a location within a wellbore and to be released from the location.

It is another object of the present invention to provide a retrievable packer with a slotted retrieval sleeve to release the packer system from the location.

It is another object of the present invention to provide a retrievable packer system having a slip device with a run-in position and set position.

It is still another object of the present invention to provide a retrievable packer system having a slotted retrieval sleeve to move the slip device from the set position back to the run-in position.

It is still another object of the present invention to provide a retrievable packer system having a lower cone in sliding engagement with a slotted retrieval sleeve to move the slip device from the set position back to the run-in position.

It is another object of the present invention to provide a retrievable packer system with a flow bypass from a retrieval mandrel to the slip for preventing debris clogs and hydraulic pressure resistance.

It is still another object of the present invention to provide a retrievable packer system having a slotted retrieval sleeve with a plurality of slots in fluid connection with the slip and chamber formed by a retrieval mandrel, a slotted retrieval sleeve, the lower cone and a lower connection sleeve.

These and other objectives and advantages of the present invention will become apparent from a reading of the attached specification, drawings and claims.

BRIEF SUMMARY OF THE INVENTION

Embodiments of the present invention include a retrievable packer system that sets and locks at a location within a borehole and also unlocks and releases from the location. The packer system of the present invention includes release components that withstand a greater range of force to release the packer system from the location and reduce the risk of fatal damage to the release components. The packer system also prevents hydraulic resistance against the release components by forming flow channels between the lower cone and packer mandrel. Previously disruptive debris clogs can no longer create the hydraulic resistance to releasing the slip. The packer system includes a packer mandrel, a lock ring, an upper cone, a lower cone, a slip device, a retrieval mandrel, a slotted retrieval sleeve, an upper connection sleeve, and a lower connection sleeve.

The lock ring has both an unlocked position and a locked position on the packer mandrel relative to a lower mandrel end. The locked position is closer to the lower mandrel end than the unlocked position. The lock ring is moveable along the packer mandrel in the unlocked position. The lock ring moves toward the lower mandrel end to lock the packer system at the location.

The slip device has both a run-in position and a set position relative to distance from an outer engagement surface of the slip device to the upper cone and the lower cone. The extended distance of the set position is greater than the initial distance of the run-in position. The extended distance corresponds to the expanded diameter of the slip device to set the packer system at the location within the borehole. The slip device has slip flow channels for fluid flow through the slip device from an inner engagement surface to the outer engagement surface.

The lock ring and the slip device are related. The slip device sets the packer system at the location, while the lock ring locks the packer system at the location. From a set and locked packer system at the location, the retrieval requires unlocking and releasing. There is interaction to unlock the lock ring so that the slip device can return the run-in position for release. The slotted sleeve releases the packer system.

Embodiments of the lower cone and the slotted retrieval sleeve further disclose the relationships for releasing the packer system from the location within the borehole from the set and locked positions. The lower cone includes a lower cone tip end facing the upper cone and a lower cone base end opposite the lower cone tip end. A slotted retrieval sleeve is mounted to the retrieval mandrel and extended into the lower cone. The slotted retrieval sleeve has a plurality of slots in fluid communication with the slot flow channels through the lower cone. The slotted retrieval sleeve has three positions relative to the lower cone, particularly the lower cone tip end of the lower cone.

An upper connection sleeve is placed on the packer mandrel above the lock ring. A lower connection sleeve is placed around the packer mandrel between the lower cone and the lower mandrel end so as to form a chamber with the lower connection sleeve, the lower cone, the retrieval mandrel, the slotted retrieval sleeve and the packer mandrel. This chamber is in fluid connection with slip flow channels of the slip.

The packer system is deployed into the borehole with the slotted retrieval sleeve in the first position. The slip device is at the initial distance and does not engage the walls of the borehole so that the packer system can travel through the borehole. The packer system is set at the location within the borehole with the slotted retrieval sleeve in the first position. The downhole operations can be performed with the packer system in this set and locked position within the borehole.

Once downhole operations have been completed with the packer system at the location, it is time to retrieve the packer system. The slotted retrieval sleeve is transitioned to a second position from the first position. The second position relative to the lower cone tip end has the slotted retrieval sleeve extended from the lower cone to contact the upper cone. The slotted retrieval sleeve is now ready to push the upper cone.

The packer system is released from the location within the borehole with the slotted retrieval sleeve in the third position. The slotted retrieval sleeve has completed pushing the upper cone away from the lower cone, which slides the slip device back to the run-in position. The packer system is no longer set at the location within the borehole. The packer system is now released from the borehole to be retrieved.

Embodiments of the upper cone and the lower cone include respective ramp surfaces cooperative with an inner slip engagement surface of the slip device. The ramp surfaces and inner slip engagement surface determine the initial distance and the extended distance of the outer slip engagement surface for the run-in position and the set position of the slip device. The slip device has slip flow channels from the inner engagement surface to the outer engagement surface.

Embodiments of the retrieval mandrel are comprised of a connection portion, a release portion, and a cut target between the connection portion and release portion. The connection portion must be separated from the release portion in order to move the slotted retrieval sleeve from the first position to the second position and to move the slotted retrieval sleeve from the second position to the third position. The release portion must disconnect so that the connection portion can be pulled upward with the packer mandrel to move the slotted retrieval sleeve.

The threads or snap fit structures are no longer solely responsible for exerting the force upward on the upper cone. The amount of force is no longer limited by the strength of these attachment structures. The chamber of the present invention is no longer exposed to debris with the likely clogging of the vent hole of the chamber. The hydraulic resistance to movement of the retrieval mandrel no longer poses a risk to the operation of retrieving the packer system. There is fluid connection between the chamber and the slip flow channels in all positions of the slotted retrieval sleeve such that the chamber is never sealed and can never build pressure against movement of the retrieval mandrel. There is no hydraulic pressure to resist or disable the retrieval mandrel and slotted retrieval sleeve as release components.

The present invention provides a retrievable packer system to isolate zones in a wellbore for downhole operations. The retrievable packer system and method sets the packer system in a location within a wellbore and releases the packer system from the location. The packer system can be set and locked in the location for the performance of a variety of downhole operations. After completion of those operations, the packer system is unlocked and released from the location to be retrieved.

DETAILED DESCRIPTION OF THE INVENTION

Figure 1:
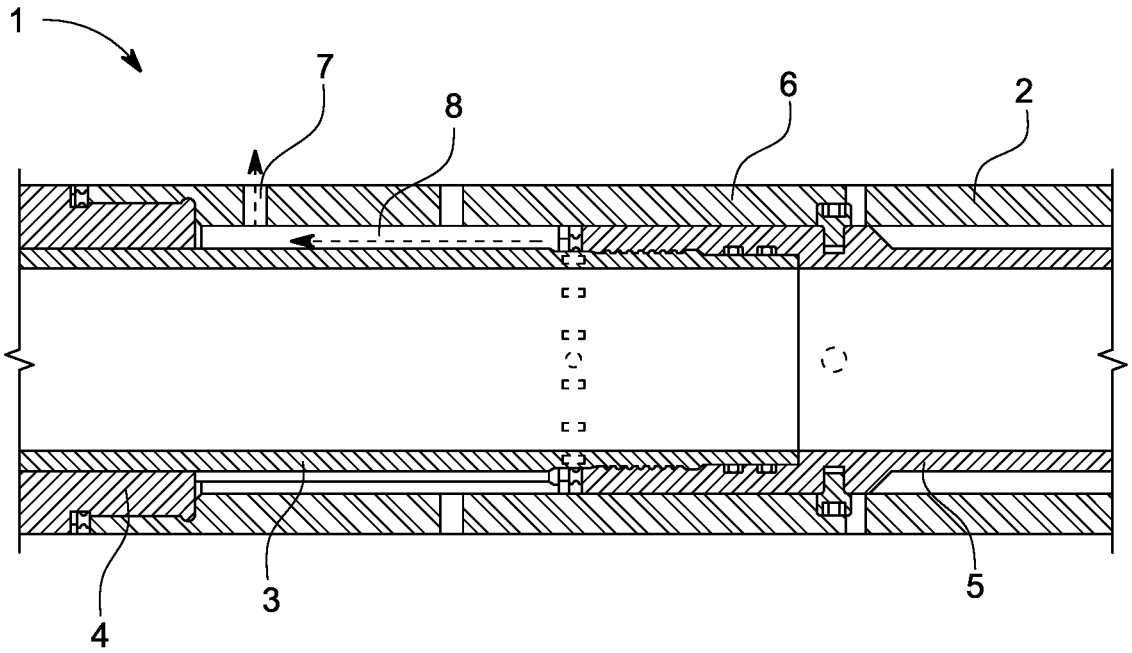
FIG. 1 PRIOR ART
FIG. 1 is a sectional view of a prior art packer system with a vented chamber that can be clogged with debris.
Figure 2:
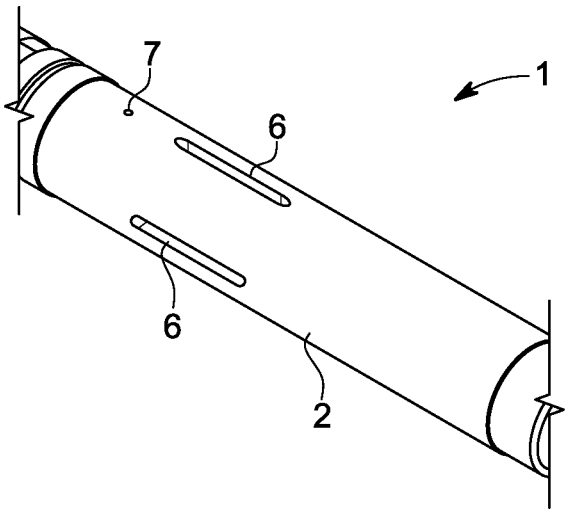
FIG. 2 PRIOR ART
FIG. 2 is a partial perspective view of the prior art packer system showing the vent hole on a lower connection sleeve.
Figure 3:
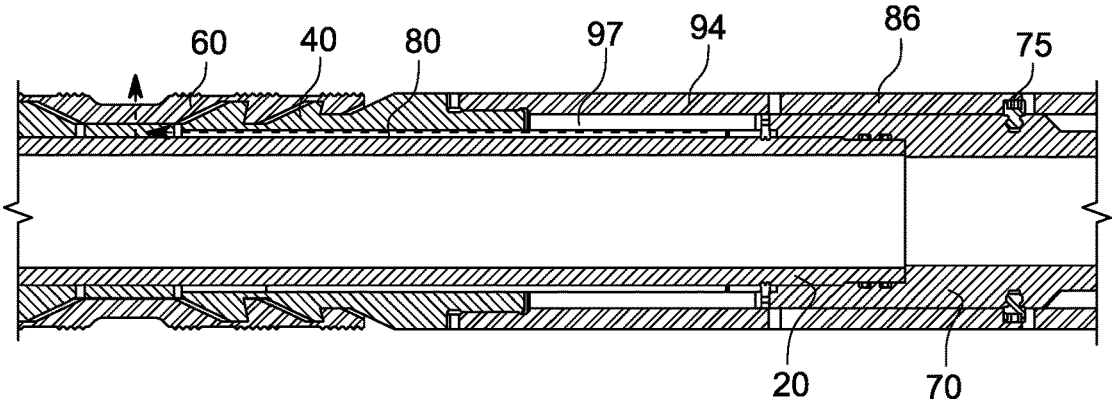
FIG. 3 is a sectional view of an embodiment of the packer system according to the present invention with the lock ring in an unlocked position, the slip device in a run-in position, and the slotted retrieval sleeve in a first position.

Retrievable packer systems release the slip devices or portions of the slip devices from the wall of the borehole or release the slip devices from cone assemblies so that the cone assemblies no longer support the slip devices against the wall of the borehole. Without the support of the cone assemblies, the slip devices are easier to release from the wall of the borehole. The amount of force for the initial release of the slip devices from the wall or from the cone assemblies can damage the release components being pulled or pressed. Release components, such as snap rings and collet fingers, can break, rendering these release components unable to function. Additionally, releasable packer systems rely on chambers with vent holes for actuation of release components, and the vent hole of the chamber being clogged can create hydraulic pressure to resist or disable the release components. The packer can become no longer retrievable, and more expensive and time consuming equipment and methods are required to remove the packer from its location in the borehole. The retrievable packer system 10 of the present invention includes release components with flow bypass to prevent hydraulic pressure resistance, greater durability to withstand the amount of force to release the slip devices and reduce the risk of fatal damage to the release components.

FIGS. 3-12 show embodiments of a retrievable packer system 10 according to the present invention. The retrievable packer system 10 comprises a packer mandrel 20, a lock ring 26, an upper cone 30, a lower cone 40, a slip device 60, a retrieval mandrel 70, and a slotted retrieval sleeve 80. The packer mandrel 20 has an upper mandrel end 22 and a lower mandrel end 24, and the lock ring 26 is attached to the packer mandrel 20 at the upper mandrel end 22. The upper cone 30 is mounted on the packer mandrel 20 between the lock ring 26 and the lower mandrel end 24. The lower cone 40 is mounted on the packer mandrel 20 between the upper cone 30 and the lower mandrel end 24. The slip device 60 is positioned between the upper cone 30 and the lower cone 40 and is in sliding engagement with the upper cone 30 and the lower cone 40. The slip device 60 is comprised of an inner engagement surface 62 facing the upper cone 30 and the lower cone 40 and an outer engagement surface 64 opposite the inner engagement surface 62. The slip device 60 has slip flow channels 65 from the inner engagement surface 62 to the outer engagement surface 64 so that the slip device 60 is in fluid connection with the borehole. Fluid at the inner engagement surface 62 can flow to the borehole through the slip flow channels 65.

Figure 4:
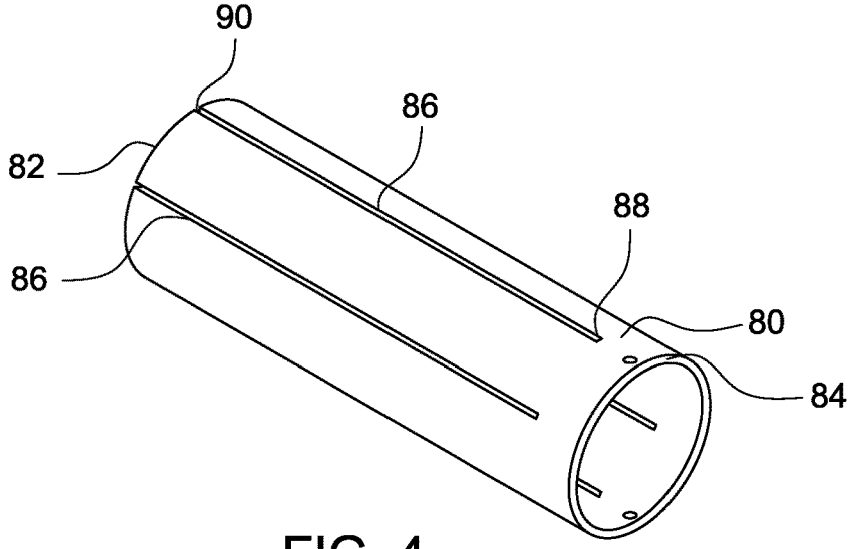
FIG. 4 is a perspective view of an embodiment of the slotted retrieval sleeve, according to the present invention.

The retrieval mandrel 70 is mounted on the packer mandrel 20 between the lower cone 40 and the lower mandrel end 24 and has a connection end 78 facing the lower cone 40. As shown in FIG. 4, the slotted retrieval sleeve 80 is mounted to the retrieval mandrel 70 and has an anchor end 84 attached to the retrieval mandrel 70, a push end 82 opposite the anchor end 84, and plurality of slots 86. Each slot of the plurality of slots 86 has an open slot end 88 at the push end 82 and a flow end 90 opposite the open slot end 88. An upper connection sleeve 92 is placed on the packer mandrel 20 above the lock ring 26. A lower connection sleeve 94 is placed around the packer mandrel 20 between the lower cone 40 and the lower mandrel end 24.

The lower connection sleeve 94 forms a chamber 97 with the lower cone 40, the retrieval mandrel 70, the slotted retrieval sleeve 80 and the packer mandrel 20. The chamber 97 is in fluid connection with the slip flow channels 65 through the slots 86. The chamber 97 has no vent hole. There is no risk of clogging the vent hole with debris, so the risk of hydraulic pressure buildup to resist or disable the actuation of the retrieval mandrel 70 is eliminated. The chamber 97 remains in fluid connection with the slip flow channels 65 for fluid bypass through the lower cone 40. There is a plurality of slots 86 so there is a much lower risk of clogging all of the slots 86. The release components of the retrieval mandrel 70 and the slotted retrieval sleeve 80 now can prevent the hydraulic pressure in the chamber 97 and provide the reliable mechanical strength for controlled release of the slip device 60 for retrieval.

Figure 8:
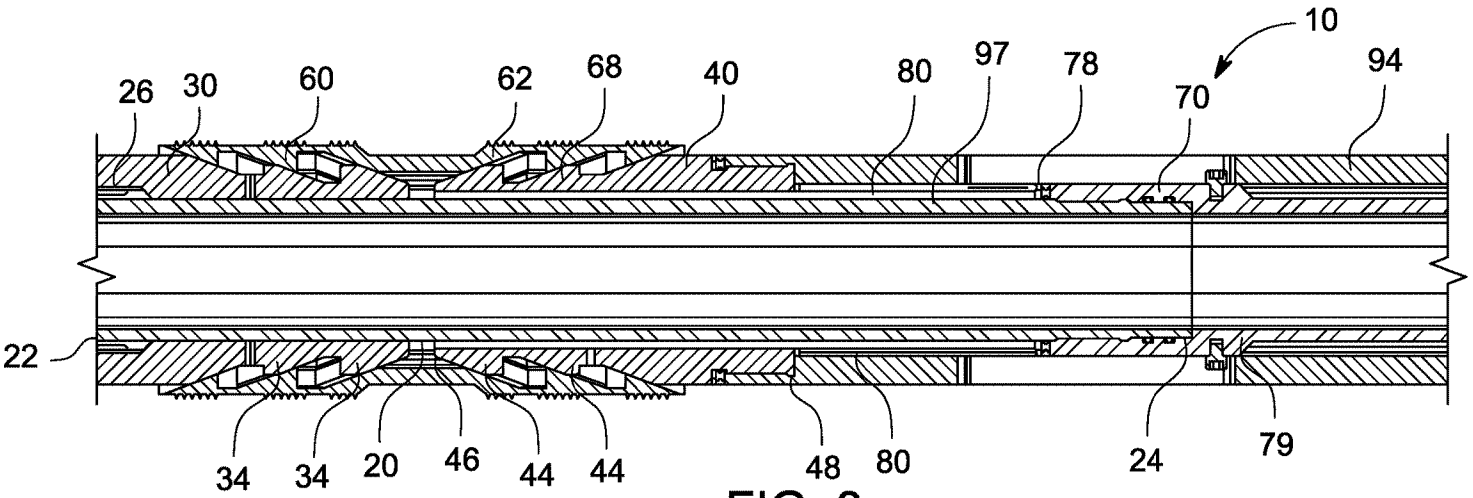
FIG. 8 is a sectional view of an embodiment of the packer system according to the present invention with the lock ring in the locked position, the slip device in a set position, and the slotted retrieval sleeve in the first position.
Figure 9:
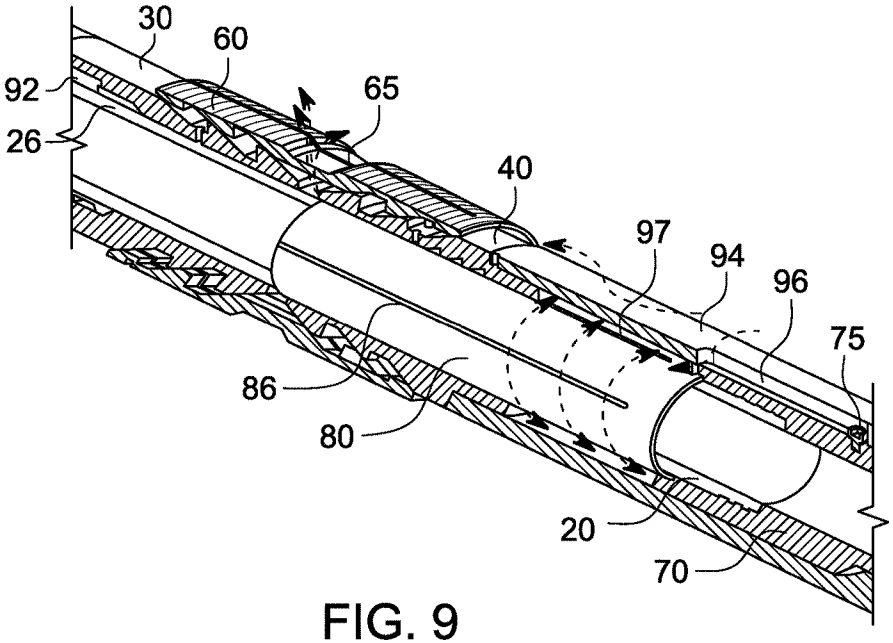
FIG. 9 is a partial perspective and sectional view of the embodiment of the packer system in FIG. 8, showing the slotted retrieval sleeve in the first position and open flow paths from the chamber to the slip in the set position.
Figure 10:
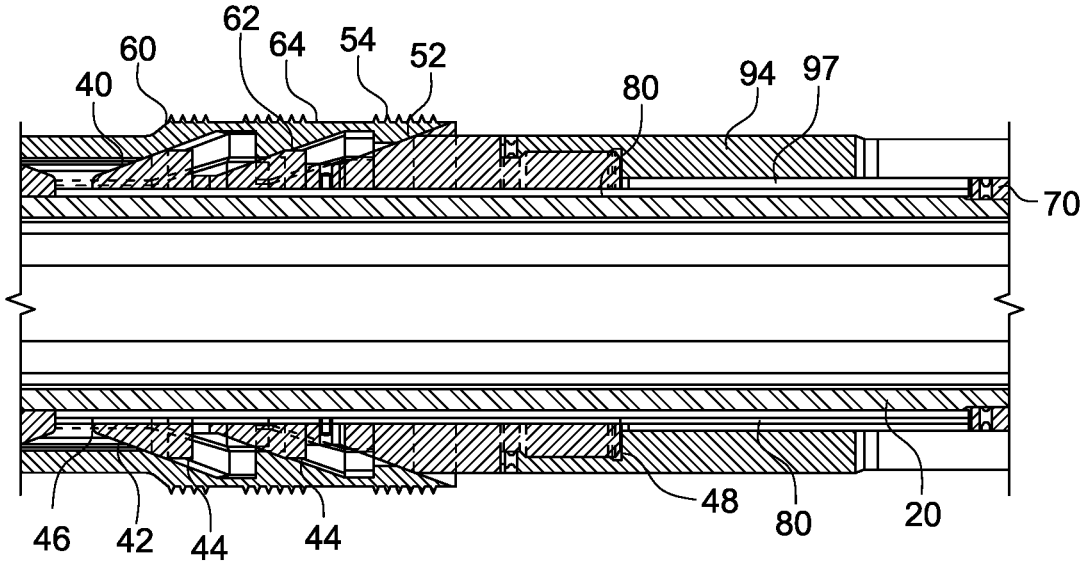
FIG. 10 is an enlarged sectional view of an embodiment of the packer system according to the present invention with the lock ring in the locked position, the slip device in the set position, and the slotted retrieval sleeve in a second position.

FIGS. 3, 5-7, and 11-12 show the lock ring 26 having an unlocked position on the packer mandrel 20 relative to the lower mandrel end 24. FIGS. 8-10 show the lock ring 26 having a locked position relative to the lower mandrel end 24. The locked position is closer to the lower mandrel end 24 than the unlocked position. The lock ring 26 is moveable along the packer mandrel 20 in the unlocked position so the unlocked position can be variable. The lock ring 26 is removably attached to the packer mandrel 20 in the locked position. Conventional locking means, such as friction fit, screw threads or clamps, can be triggered to transition the lock ring 26 between the unlocked position and the locked position.

FIGS. 3, 5-7 and 11-12 show the slip device 60 having a run-in position with the outer engagement surface 64 at an initial distance from the upper cone 30 and the lower cone 40. FIGS. 8-10 also show the slip device 60 having a set position with the outer engagement surface 64 at an extended distance from the upper cone 30 and the lower cone 40. The extended distance is greater than the initial distance so as to hold position of the packer mandrel 20 in the wellbore. The extended distance corresponds to the expanded diameter of the slip device 60 to grip the walls of the borehole or wellbore or casing. There can be additional gripping means, such as a textured surface, adhesive, or grit coatings on the outer engagement surface 64 for resilient attachment to the walls. The slip device 60 holds the packer system 10 at the location in the wellbore. The slip device 60 has slip flow channels 65 from the inner engagement surface 62 to the outer engagement surface 64 so that the slip device 60 is in fluid connection with the borehole. As indicated by arrows, fluid flow at the inner engagement surface 62 can bypass to the borehole through the slip flow channels 65. The chambers and flow paths in fluid communication with the space at the inner engagement surface 62 can also bypass to the borehole through the slip flow channels 65.

The lock ring 26 and the slip device 60 are related. The lock ring 26 is set from the unlocked position to the locked position, when the slip device 60 is in the set position. Thus, the lock ring 26 holds the slip device 60 with the outer engagement surface 64 at the extended distance to set the packer system 20 in the location in the wellbore. The lock ring 26 must be transitioned from the locked position to the unlocked position before slip device 60 transitions from the set position to the run-in position. Thus, there is an embodiment with the slip device 60 is in the set position with the lock ring 26 in the locked position and in the unlocked position.

Embodiments of the present invention in FIGS. 3-12 include the lower cone 40 being comprised of a lower cone tip end 46 facing the upper cone 30, and a lower cone base end 48 opposite the lower cone tip end 46. FIGS. 3 and 5-12 show the three positions of the slotted retrieval sleeve 80 of FIG. 4.

FIGS. 3, and 5-9 show the slotted retrieval sleeve 80 in a first position relative to the lower cone tip end 46 with the push end 82 within the lower cone 40 with slip device 60 in both the run-in position and the set position. The packer system 10 is deployed into the borehole with the slotted retrieval sleeve 80 in the first position. The slip device 60 is at the initial distance and does not engage the walls of the borehole. The packer system 10 is attached to the wall of the borehole at a location within the wellbore with the slotted retrieval sleeve 80 in the first position. The slip device 60 is at the extended distance and can be locked at the location with the lock ring 26. The setting of the packer system 10 with the locking ring 26 transitioning from the unlocked position (FIGS. 3 and 5) to the locked position (FIGS. 6-9) is concurrent with the slotted retrieval sleeve 80 in a stable position (first position) relative to the lower cone 40. The chamber 97 remains in fluid connection across the lower cone 40 to the slip flow channels 65 so that conventional settings of the slip device 60 can be performed. The slotted retrieval sleeve 80 and the retrieval mandrel 70 as the release components of the packer system 10 do not interfere with setting the position in the borehole, and these release components are not exposed the risk of damage for the setting operation.

FIG. 10 shows the slotted retrieval sleeve 80 having a second position relative to the lower cone tip end 46 with the push end 82 extended from the lower cone 40 and in contact with the upper cone 30 with the slip device 60 in the set position. The second position is extended past the lower cone tip end 46 and out of the lower cone 40. Once downhole operations have been completed with the packer system 10 at the location, it is time to retrieve the packer system 10. The slotted retrieval sleeve 80 is transitioned to the second position from the first position by the retrieval mandrel 70. The slotted retrieval sleeve 80 can also be transitioned to the second position from the first position before the downhole operations are completed. As long as the slotted retrieval sleeve 80 is not pushing the upper cone 30, the slotted retrieval sleeve 80 could remain abutted against the upper conde 30 during downhole operations.

Figure 11:
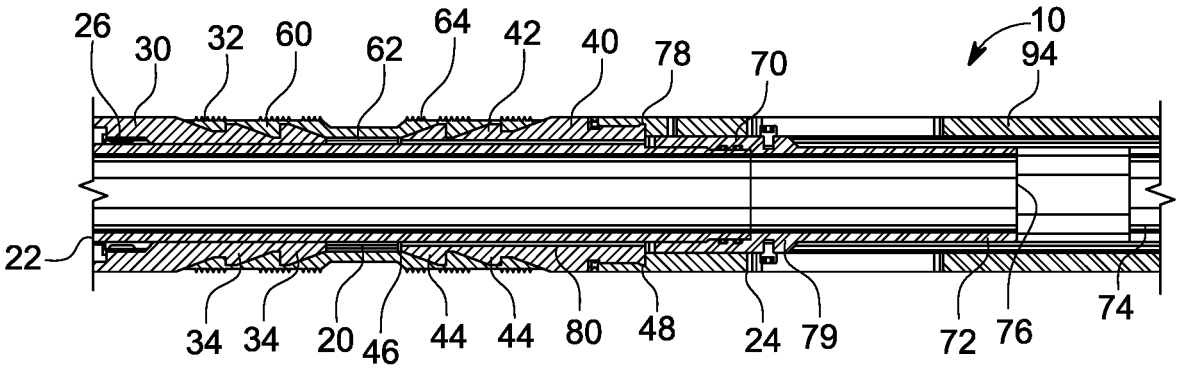
FIG. 11 is a sectional view of an embodiment of the packer system according to the present invention with the lock ring in the locked position, the slip device in the run-in position, and the slotted retrieval sleeve in a third position.
Figure 12:
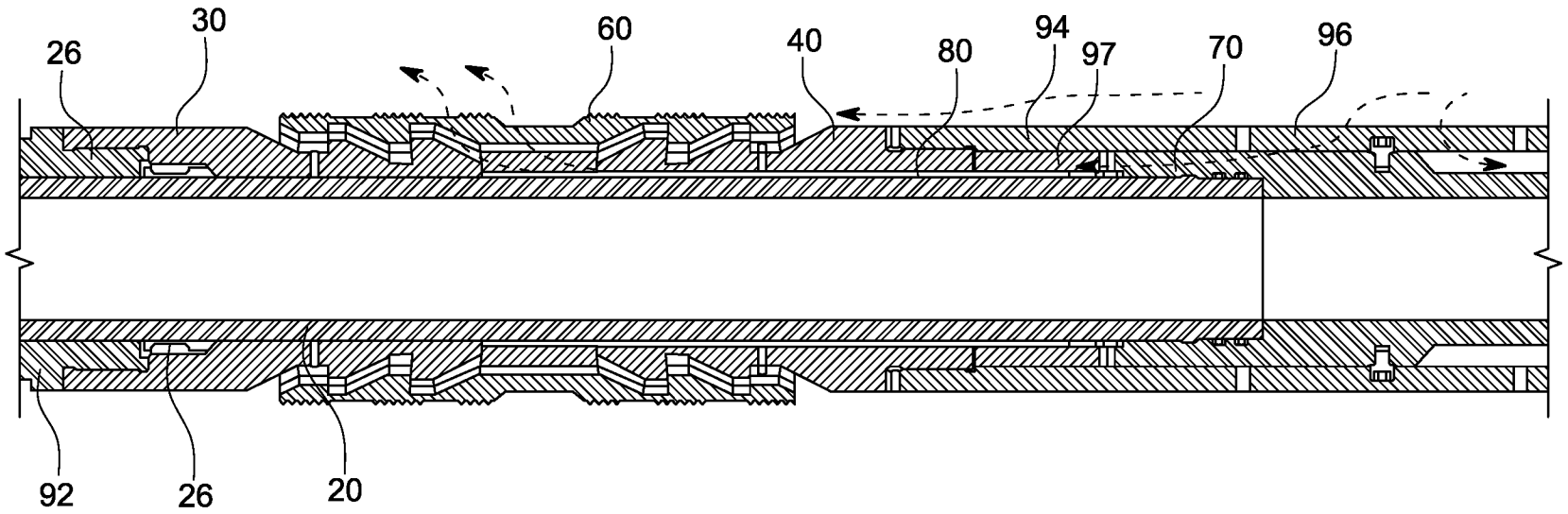
FIG. 12 is a partial perspective and sectional view of the embodiment of the packer system in FIG. 11, showing the slotted retrieval sleeve in the third position and open flow paths from the chamber to the slip back in the run-in position.

FIGS. 11-12 show the slotted retrieval sleeve 80 having a third position with the push end 82 extended from the lower cone 40 and in contact with the upper cone 30 with the slip device 60 in the run-in position. The third position is farther from the lower cone 40 than the second position. The push end 82 remains out of the lower cone 40. The slotted retrieval sleeve 80 pushes the upper cone 30 off the slip device 60 in the set position so that the slip device 60 slides into the run-in position and the upper cone 30 separates from the lower cone 40. The slip device 60 is returned to the initial distance to release attachment to the wall at the location within the borehole. The packer system 10 is now released from the borehole to be retrieved. The slotted retrieval sleeve 80 can remain in the third position for retrieval or return to the first position for re-setting.

Embodiments of the upper cone 30 and the lower cone 40, include the upper cone 30 being comprised of an upper ramp surface 32 angled outward toward the upper mandrel end 22, and the lower cone 40 being comprised of a lower ramp surface 42 being angled outward toward the lower mandrel end 24. The upper ramp surface 32 can be comprised of at least one conical surface 34, and the lower ramp surface 42 can be comprised of at least one conical surface 44.

The slip device 60 includes embodiments cooperative with the upper ramp surface 32 and the lower ramp surface 42. Embodiments of the slip device include the inner engagement surface 62 being comprised of an upper slip engagement surface 66 in sliding engagement with both the upper ramp surface 32 and a lower slip engagement surface 68 in sliding engagement with the lower ramp surface 42. The slip device 60 is complementary to the ramp surfaces 32, 42 of the respective cones 30, 40. The tops of the conical surfaces 34, 44 engaging complementary conical portions of the upper slip engagement surface 66 and lower slip engagement surface 68 determine the extended distance of the outer engagement surface 64 at the set position of the slip device 60. The top of conical surfaces 34, 44 engaging the gaps between complementary conical portions of the upper slip engagement surface 66 and lower slip engagement surface 68 determine the initial distance of the outer engagement surface 64 at the run-in position of the slip device 60.

Embodiments shown in FIGS. 3 and 5-12, in particular FIG. 11, include the retrieval mandrel 70 being comprised of a connection portion 72, a release portion 74, and a cut target 76 between the connection portion 72 and release portion 74. The connection portion 72 has the connection end 78. FIGS. 3 and 5-12 show the connection portion 72 having a greater wall thickness than the release portion 74. FIGS. 3 and 5-12 further show the retrieval mandrel 70 having a conical section 79 with a diameter increasing from the release portion 74 to the connection portion 72.

The connection portion 72 can be separated from the release portion 74 in order move the slotted retrieval sleeve 80 from the first position to the second position. The release portion 74 must disconnect so that the connection portion 72 can be pulled upward with the packer mandrel 20 to move the slotted retrieval sleeve 80. The connection portion 72 of the retrieval mandrel 70 is separated from the release portion 74, when the slotted retrieval sleeve 80 is in the second position and when the slotted retrieval sleeve 80 is in the third position. The connection portion 72 of the retrieval mandrel 70 is integral with the release portion 74 by the cut target 76, when the slotted retrieval sleeve 80 is in the first position. The first position to second position is the transition with the cut target 76 being cut with the slotted retrieval sleeve 80 in the first position. The relative position of the slotted retrieval sleeve 80 to the lower cone 40 is enabled by the retrieval mandrel 70 as a driving force of the release of the slip device 60 and eventual retrieval of the packer system 10.

The slotted retrieval sleeve 80 include the embodiments shown in FIGS. 3-12, including FIG. 4. The slotted retrieval sleeve 80 is fixedly attached to the connection end 78. The attachment can be threaded engagement, snap fit, friction fit, made integral or other known mechanical connection. FIG. 4 further shows that the dimensions and number of slots 86 can be selected to circumscribe the slotted retrieval sleeve 80. The arrangement can be circumferential with even or uneven distribution.

Figure 5:
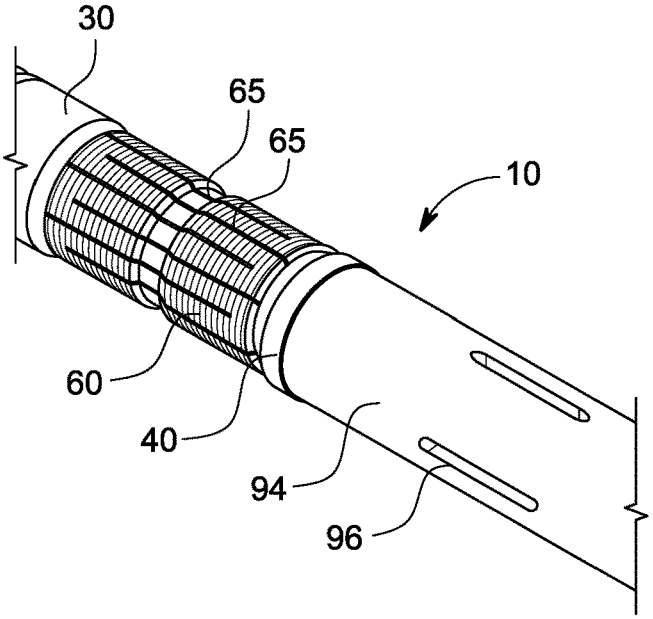
FIG. 5 is a partial perspective view of the embodiment of the packer system in FIG. 3, showing the lower connection sleeve without any vent hole.
Figure 6:
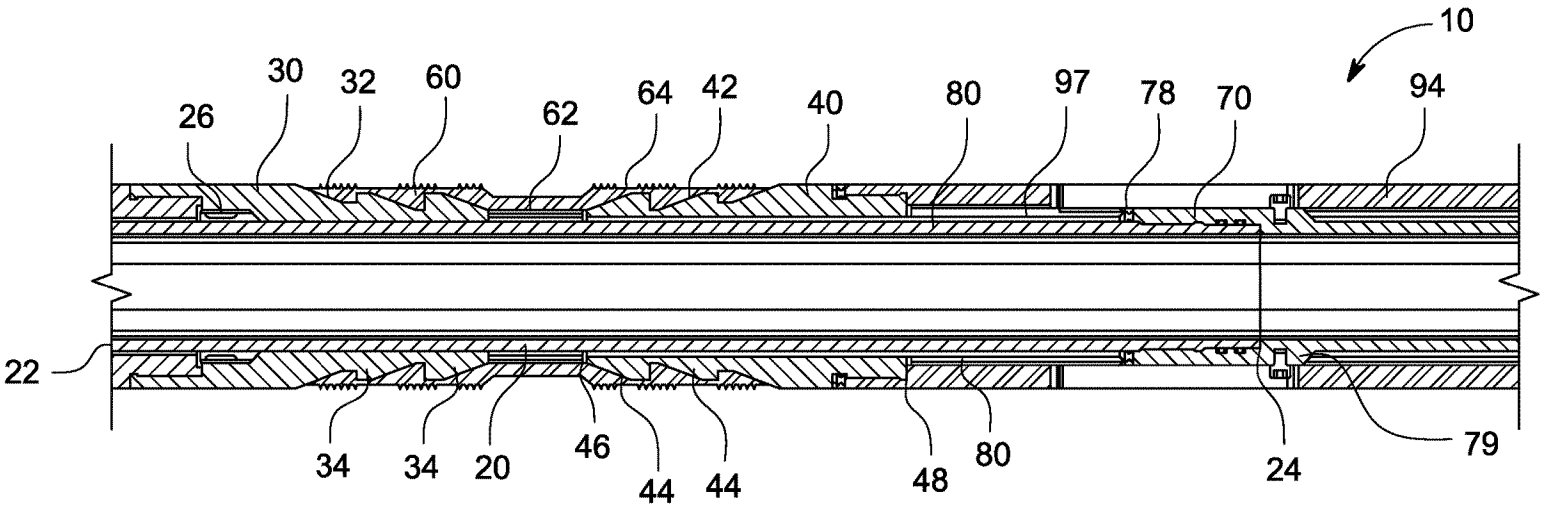
FIG. 6 is a sectional view of an embodiment of the packer system according to the present invention with the lock ring in a locked position, the slip device in the run-in position, and the slotted retrieval sleeve in the first position.
Figure 7:
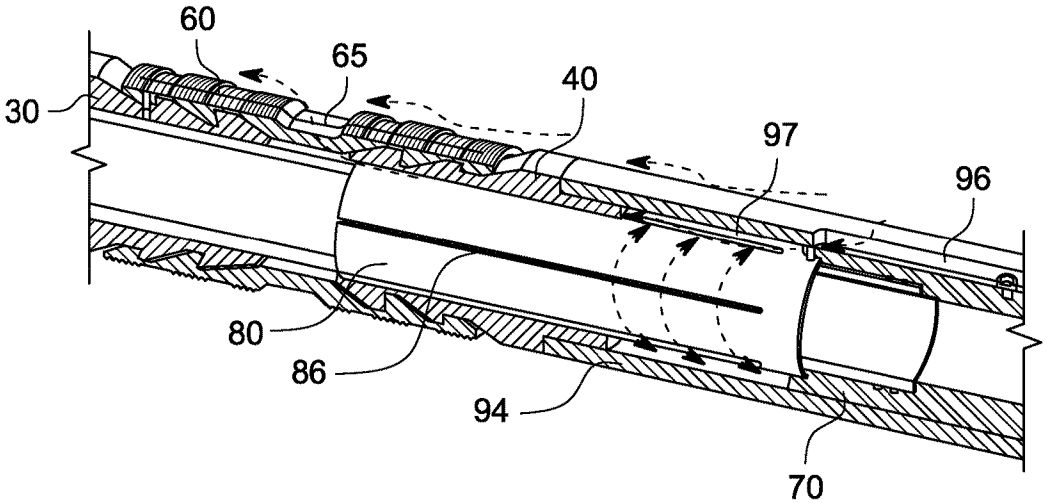
FIG. 7 is a partial perspective and sectional view of the embodiment of the packer system in FIG. 6, showing the slotted retrieval sleeve in the first position and open flow paths from the chamber to the slip in the run-in position.

FIGS. 5, 7, 9, and 11 show additional embodiments of the lower connection sleeve 94 being comprised of a sleeve slot 96 and the connection portion 72 of the retrieval mandrel 70 having a peg 75. FIGS. 5, 7, and 9 show the lower connection sleeve 94 with the peg 75 in the sleeve slot 96 with the slotted retrieval sleeve 80 in first position. The packer system 10 is being run in and set in FIGS. 5, 7 and 9, showing the peg 75 in the same position. FIG. 11 shows the peg 75 in a different position in the sleeve slot 96 indicating movement of the retrieval mandrel 70 and the slotted retrieval sleeve 80 to the third position. There is no view of the peg 75 with the slotted retrieval sleeve 80 in the second position, according to FIG. 10. The pulling from above is on the packer mandrel 20, while the packer mandrel 20 is moveable relative the upper connection sleeve 92 and the lower connection sleeve 94.

Embodiments of the present invention include a method for downhole operations with the packer system 10. The method includes running the packer system 10 in a borehole, with the slip device 60 in the run-in position, the lock ring 26 in the unlocked position, and the slotted retrieval sleeve 80 in the first position as in FIGS. 3 and 5-7. The packer system 10 is free to move through the borehole without engaging the walls of the borehole.

The packer system 10 is placed in a location in the wellbore, and the upper cone 30 is moved closer to the lower cone 40 along the packer mandrel 20. The method includes sliding the slip device 60 from the run-in position to the set position, while the slotted retrieval sleeve 80 remains in the first position. The step of sliding the slip device 60 is also concurrent with the slotted retrieval sleeve 80 in the first position, as in FIGS. 8-9.

At the set position, the packer system 10 is fixed at the location as in FIGS. 8-9. The lock ring 26 can be transitioned from the unlocked position to the locked position. The packer system 10 is now fixed and locked in the location so as to hold the packer system 10 with the slip device 60 in the set position and the slotted retrieval sleeve 80 in the first position. Downhole operations, such as injecting, producing, fracking, and others, can be performed with the packer system 10 fixed and locked in the location. The method includes the step of performing these downhole operations, after the step of transitioning the lock ring from the unlocked position to the locked position with the packer system at the location.

Once downhole operations are completed, the method includes moving the slotted retrieval sleeve 80 from the first position to the second position with the slip device 60 still in the set position. In some embodiments of the method, the step of performing these downhole operations can be after the step of transitioning the lock ring from the unlocked position to the locked position with the packer system at the location and after the step of moving the slotted retrieval sleeve 80 from the first position to the second position. The downhole operations can be performed when the slotted retrieval sleeve 80 is in the first position or second position. Depending on when the retrieval mandrel 70 is cut to be able to move the slotted retrieval sleeve 80 outside of the lower cone 40 and to the upper cone 30, the step of performing the downhole operations can be adjusted.

With the slotted retrieval sleeve 80 at the second position as in FIG. 10, the method includes transitioning the lock ring 26 from the locked position to the unlocked position. The upper cone 30 is now free to move along the packer mandrel 20. The slotted retrieval sleeve 80 contacts the upper cone 30 in this second position. With the lock ring 26 in the unlocked position, the retrieval mandrel 70 and the slotted retrieval sleeve 80, as the release components, are now ready to move even further.

The method includes pushing the upper cone 30 further from the lower cone 40 along the packer mandrel 20 concurrent with the step of moving the slotted retrieval sleeve 80 from the second position to the third position. The slip device 60 slides from the set position to the run-in position so as to release the packer system 10 from the location as the slotted retrieval sleeve 80 reaches the third position, as shown in FIGS. 11-12. The method now includes retrieving the packer system 10 with the slip device 60 in the run-in position and with the slotted retrieval sleeve 80 in the third position as in FIG. 11-12 or with the slotted retrieval sleeve 80 returned to the first position, as already shown in FIG. 3.

Embodiments of the method include applying pressure from above the lock ring 26 in the step of moving the upper cone 30 closer to the lower cone 40 along the packer mandrel 20. As shown in FIGS. 8 and 9, the packer system 10 with the upper connection sleeve 92 placed on the packer mandrel 20 above the lock ring 26, the step of applying pressure to the packer system 10 is comprised of the step of applying pressure with the upper sleeve 92 on the lock ring 26 and the upper cone 30.

In another alternative embodiment, the step of moving the slotted retrieval sleeve 80 from the first position to the second and third positions further comprises the steps of: separating the connection portion 72 from the release portion 74 at the cut target 76 of the retrieval mandrel 70 as in FIG. 11; and pulling the packer mandrel 20 without the release portion 74 towards the upper cone 30. The step of separating the connection portion 72 comprises the steps of: deploying a cutting tool to the cut target 76; and cutting the retrieval mandrel 70 at the cut target 76. The first position is an important transition to change the relative positions of the slotted retrieval sleeve 80 and the lower cone 40. In the first position, the connection portion 72 can be separated or made integral with the release portion 74 of the retrieval mandrel 70. The step of separating can be before or after the downhole operations are completed. Depending on when the cut target 76 can be cut, the step of separating can be before or after the packer system 10 performs the downhole operation. The slotted retrieval sleeve 80 can reach the second position of FIG. 10 and then the third position of FIGS. 11-12.

The lock ring 26 can already be in both the unlocked position and the locked position with the slotted retrieval sleeve 80 in the first position. The lock ring 26 can also be in both the locked position and the locked position with the slotted retrieval sleeve 80 in the second position. However, the lock ring 26 must transition into the unlocked position for the push rods 80 to move to from the second position to the third position. The upper cone 30 must be released to move. The lock ring 26 must be in the unlocked position with the slotted retrieval sleeve 80 in the third position.

The method further includes the steps of pulling the packer mandrel 20 towards the upper cone 30 again and pushing the upper cone 30 with the slotted retrieval sleeve 80 until the slotted retrieval sleeve 80 reaches the third position. The step of moving the slotted retrieval sleeve 80 from the first position to the second position and then the third position further comprises a step of pulling the packer mandrel 20 without the release portion 74 further towards the upper cone. The step of pushing the upper cone 30 further from the lower cone 40 is comprised of the step of pushing the upper cone 30 with the slotted retrieval sleeve 80.

The present invention provides a retrievable packer system to isolate zones in a wellbore for downhole operations. The retrievable packer system and method sets the packer system in a location within a wellbore and releases the packer system from the location. The packer system can be set and locked in the location for the performance of a variety of downhole operations. After completion of those operations, the packer system has a slotted retrieval sleeve to release the packer system from the location to be retrieved.

The packer system has a slotted retrieval sleeve and retrieval mandrel as release components. The slotted retrieval sleeve is cooperative with the lower cone and retrieval mandrel to push the upper cone and return the slip device to the run-in position from the set position. Once the release portion of the retrieval mandrel is separated, the packer mandrel can be pulled upward without the release portion. The connection portion pulls upward along with the packer mandrel to bring the slotted retrieval sleeve to the second position in abutment with the upper cone. Once the lock ring is switched from the locked position to the unlocked position, the upper cone is free to move. As the packer mandrel can be pulled further upward, the slotted retrieval sleeve pushes the upper cone further away, which slides the slip device back into the run-in position.

The release components of the retrievable packer system now form a flow bypass from a retrieval mandrel to the slip device. There is no vent hole in the lower connection sleeve anymore, nor dependance on any single vent hole to release fluid pressure from the chamber formed by the lower connection sleeve, the lower cone, the retrieval mandrel, the slotted retrieval sleeve and the packer mandrel. The slotted retrieval sleeve makes a fluid connection from the chamber to the slip device with slip flow channels to the borehole. There is fluid bypass from the chamber through multiple slots in the slotted retrieval sleeve to prevent debris clogs. The clog of any single slot can no longer create hydraulic pressure to resist or disable the actuation of the retrieval mandrel and the slotted retrieval sleeve.

The slotted retrieval sleeve remains compatible with different amounts of force to return the slip device in the set position back to the run-in position. The slotted retrieval sleeve and retrieval mandrel are release components are not snap rings or shear screws that are the mechanical limitation for the amount of force to be exerted against the upper cone to slide the slip device back into the run-in position. The present invention still avoids the fragility of other release components, increases the amount of force available to push the upper cone, and reduces the risk of disabling hydraulic resistance for the reliable retrieval of the packer system.

The foregoing disclosure and description of the invention is illustrative and explanatory thereof. Various changes in the details of the illustrated structures, construction and method can be made without departing from the true spirit of the invention.

We claim:

1. A retrievable packer system, comprising:

a packer mandrel having an upper mandrel end and a lower mandrel end;

a lock ring being attached to said packer mandrel at said upper mandrel end and having an unlocked position on said packer mandrel relative to said lower mandrel end and a locked position relative to said lower mandrel end, said locked position being closer to said lower mandrel end than said unlocked position, said lock ring being removably attached to said packer mandrel at said locked position;

an upper cone mounted on said packer mandrel between said lock ring and said lower mandrel end;

a lower cone mounted on said packer mandrel between said upper cone and said lower mandrel end, wherein said lower cone is comprised of:

a lower cone tip end facing said upper cone;

a lower cone base end opposite said lower cone tip end; and a slip device being between said upper cone and said lower cone and being in sliding engagement with said upper cone and said lower cone, wherein said slip device is comprised of an inner engagement surface facing said upper cone and said lower cone and an outer engagement surface opposite said inner engagement surface, said slip device having slip flow channels from said inner engagement surface to said outer engagement, and wherein said slip device has a run-in position with said outer engagement surface at an initial distance from said upper cone and said lower cone and a set position with said outer engagement surface at an extended distance from said upper cone and said lower cone, said extended distance being greater than said initial distance so as to hold position of said packer mandrel in a borehole;

a retrieval mandrel being mounted on said packer mandrel between said lower cone and said lower mandrel end and having a connection end facing said lower cone; and a slotted retrieval sleeve being mounted to said retrieval mandrel and extended into said lower cone and being comprised of an anchor end attached to said retrieval mandrel, a push end opposite said anchor end, and a plurality of slots, each slot of said plurality of slots have an open slot end at said push end and flow end opposite said open slot end;

an upper connection sleeve placed on said packer mandrel above said lock ring; and a lower connection sleeve being placed around said packer mandrel between said lower cone and said lower mandrel end so as to form a chamber with said lower connection sleeve, said lower cone, said retrieval mandrel, said slotted retrieval sleeve and said packer mandrel, said chamber being in fluid connection with slip flow channels.

2. The packer system, according to claim 1, wherein said slotted retrieval sleeve has a first position relative to said lower cone tip end with said push end within said lower cone with slip device in said run-in position and with said slip device in said set position, wherein said slotted retrieval sleeve has a second position relative to said lower cone tip end with said push end extended from said lower cone and in contact with said upper cone with said slip device in said set position, said second position being extended past said lower cone tip end, and wherein said slotted retrieval sleeve has a third position with said push end extended from said lower cone and in contact with said upper cone with said slip device in said run-in position, said third position being farther from said lower cone tip end than said second position.

3. The packer system, according to claim 1, wherein said upper cone is comprised of an upper ramp surface angled outward toward said upper mandrel end, and wherein said lower cone is comprised of a lower ramp surface angled outward toward said lower mandrel end.

4. The packer system, according to claim 3, wherein said upper ramp surface is comprised of at least one upper conical surface, and wherein said lower ramp surface is comprised of at least one lower conical surface.

5. The packer system, according to claim 1, wherein said inner engagement surface is comprised of an upper slip engagement surface in sliding engagement with said upper ramp surface and a lower slip engagement surface in sliding engagement with said lower ramp surface, wherein said outer engagement surface is at said initial distance from said upper ramp surface and said lower ramp surface in said run-in position, and wherein said outer engagement surface is at said extended distance from said upper ramp surface and said lower ramp surface.

6. The packer system, according to claim 1, wherein said retrieval mandrel is comprised of a connection portion, a release portion, and a cut target between the connection portion and release portion, and wherein said lower connection sleeve is comprised of a sleeve slot, said connection portion of retrieval mandrel being moveable within said sleeve slot.

7. The packer system, according to claim 6, wherein said connection portion is further comprised of a peg extending into said sleeve slot.

8. The packer system, according to claim 6, wherein said connection portion has a greater wall thickness than the release portion.

9. The packer system, according to claim 6, said retrieval mandrel having a conical section with a diameter increasing from said release portion to said connection portion.

10. The packer system, according to claim 6, wherein said connection portion of said retrieval mandrel is separated from said release portion with said slotted retrieval sleeve in said second position.

11. The packer system, according to claim 6, wherein said connection portion of said retrieval mandrel is separated from said release portion with said slotted retrieval sleeve in said third position.

12. The packer system, according to claim 6, wherein said connection portion of said retrieval mandrel is made integral with said release portion by said cut target with said slotted retrieval sleeve in said first position.

13. The packer system, according to claim 1, wherein said plurality of slots are arranged circumferentially around said slotted retrieval sleeve.

14. A method for downhole operations, comprising the steps of:

running a packer system, according to claim 1, in a borehole, with said slip device in said run-in position, said lock ring in said unlocked position, and said slotted retrieval sleeve in said first position;

placing said packer system at a location in the wellbore;

moving said upper cone closer to said lower cone along said packer mandrel;

sliding said slip device from said run-in position to said set position;

transitioning said lock ring from said unlocked position to said locked position with said packer system at said location so as to hold said packer system with said slip device in said set position and with said slotted retrieval sleeve in said first position;

moving said slotted retrieval sleeve from said first position to said second position, said slip device being in said set position with said slotted retrieval sleeve in said second position;

transitioning said lock ring from said locked position to said unlocked position with said packer system at said location and with said slotted retrieval sleeve in said second position;

moving said slotted retrieval sleeve from said second position to said third position;

pushing said upper cone further from said lower cone along said packer mandrel concurrent with the step of moving said slotted retrieval sleeve from said second position to said third position;

sliding said slip device from said set position to said run-in position so as to release said packer system from said location; and retrieving said packer system with said slip device in said run-in position and with said slotted retrieval sleeve in said third position.

15. The method for downhole operations, according to claim 14, further comprising the step of:

performing downhole operations, after the step of transitioning said lock ring from said unlocked position to said locked position with said packer system at said location.

16. The method for downhole operations, according to claim 15, wherein said retrieval mandrel is comprised of a connection portion, a release portion, and a cut target between the connection portion and release portion, and wherein the step of moving said slotted retrieval sleeve from said first position to said second position further comprises the steps of:

separating said connection portion from said release portion at said cut target; and pulling said mandrel without said release portion towards said upper cone.

17. The method for downhole operations, according to claim 16, wherein the step of separating said connection portion comprises the steps of:

deploying a cutting tool to said cut target; and cutting said retrieval mandrel at said cut target.

18. The method for downhole operations, according to claim 16, wherein the step of moving said slotted retrieval sleeve from said second position to said third position further comprises the step of pulling said packer mandrel without said release portion further towards said upper cone, and wherein the step of pushing said upper cone further from said lower cone is comprised of a step of pushing said upper cone with said slotted retrieval sleeve.

19. The method for downhole operations, according to claim 14, wherein the step of moving said upper cone closer to said lower cone along said packer mandrel comprises a step of applying pressure to said packer system from above said lock ring.

20. The method for downhole operations, according to claim 19, wherein the step of applying pressure to said packer system is comprised of the step of applying pressure with said upper sleeve on said lock ring and said upper cone.

* * * * *